US011189408B2

(12) United States Patent
Yoshidome et al.

(10) Patent No.: US 11,189,408 B2
(45) Date of Patent: Nov. 30, 2021

(54) SOFT MAGNETIC ALLOY AND MAGNETIC DEVICE

(71) Applicant: TDK CORPORATION, Tokyo (JP)

(72) Inventors: Kazuhiro Yoshidome, Tokyo (JP); Hiroyuki Matsumoto, Tokyo (JP); Kenji Horino, Tokyo (JP); Akito Hasegawa, Tokyo (JP); Yu Yonezawa, Tokyo (JP); Syota Goto, Tokyo (JP); Seigo Tokoro, Tokyo (JP)

(73) Assignee: TDK CORPORATION, Tokyo (JP)

( * ) Notice: Subject to any disclaimer, the term of this patent is extended or adjusted under 35 U.S.C. 154(b) by 251 days.

(21) Appl. No.: 15/904,986

(22) Filed: Feb. 26, 2018

(65) Prior Publication Data

US 2018/0247744 A1 Aug. 30, 2018

(30) Foreign Application Priority Data

Feb. 27, 2017 (JP) ..... JP2017-035384

(51) Int. Cl.

| | |
|---|---|
| ***H01F 1/153*** | (2006.01) |
| ***C22C 45/02*** | (2006.01) |
| ***C22C 38/20*** | (2006.01) |
| ***C22C 33/00*** | (2006.01) |
| ***C22C 38/04*** | (2006.01) |
| ***C22C 38/02*** | (2006.01) |
| ***H01F 41/02*** | (2006.01) |

(Continued)

(52) U.S. Cl.

CPC ..... *H01F 1/1535* (2013.01); *C22C 33/003* (2013.01); *C22C 38/02* (2013.01); *C22C 38/04* (2013.01); *C22C 38/12* (2013.01); *C22C 38/14* (2013.01); *C22C 38/16* (2013.01); *C22C 38/20* (2013.01); *C22C 45/02* (2013.01); *H01F 1/15308* (2013.01); *H01F 41/0246* (2013.01); *C22C 2200/02* (2013.01); *C22C 2202/02* (2013.01); *H01F 41/0226* (2013.01)

(58) Field of Classification Search

CPC ..... C22C 2200/02; C22C 2202/02; C22C 33/003; C22C 38/02; C22C 38/16; C22C 38/20; C22C 45/02; H01F 1/15308; H01F 41/0226

See application file for complete search history.

(56) References Cited

U.S. PATENT DOCUMENTS

2017/0178776 A1* 6/2017 Kudo ..... C22C 38/20

FOREIGN PATENT DOCUMENTS

CN 102 412 045 B 3/2014
CN 104934179 * 9/2015

(Continued)

OTHER PUBLICATIONS

May 16, 2018 extended European Search Report issued in European Patent Application No. 18158955.7.

*Primary Examiner* — Nicholas A Wang
(74) *Attorney, Agent, or Firm* — Oliff PLC

(57) ABSTRACT

Provided is a soft magnetic alloy including Fe as a main component, in which a slope of an approximate straight line, plotted between cumulative frequencies of 20 to 80% on Fe content in each grid of 80000 grids or more, each of which has 1 nm×1 nm×1 nm, is −0.1 to −0.4, provided that Fe content (atom %) of each grid is Y axis, and the cumulative frequencies (%) obtained in descending order of Fe content in each grid is X axis, and an amorphization ratio X is 85% or more.

14 Claims, 3 Drawing Sheets

(51) Int. Cl.

| | |
|---|---|
| ***C22C 38/12*** | (2006.01) |
| ***C22C 38/14*** | (2006.01) |
| ***C22C 38/16*** | (2006.01) |

(56) References Cited

FOREIGN PATENT DOCUMENTS

| | | | | |
|---|---|---|---|---|
| EP | 2 149 616 | A1 | | 2/2010 |
| JP | 2000-030924 | A | | 1/2000 |
| JP | 2001295005 | | * | 10/2001 |
| JP | 200640906 | | * | 2/2006 |
| JP | 2016-211017 | A | | 12/2016 |
| WO | 2008/133301 | A1 | | 11/2008 |

* cited by examiner

SOFT MAGNETIC ALLOY AND MAGNETIC DEVICE

BACKGROUND OF THE INVENTION

1. Field of the Invention

The present invention relates to a soft magnetic alloy and a magnetic device.

2. Description of the Related Art

In recent years, low power consumption and high efficiency are demanded in electronic, information, communication equipment, etc. In addition, the above demands are becoming stronger towards a low carbon society. Therefore, reduction of energy loss or improvement of power supply efficiency are also required for power supply circuits of electronic, information, communication equipment, etc. For the magnetic core of the ceramic element to be used in the power supply circuit, improvement of magnetic permeability and reduction of core loss (magnetic core loss) are required. If the core loss is reduced, the loss of power energy will be reduced, thereby high efficiency and energy saving can be achieved.

Patent Document 1 describes that by changing the grain shape of the powder, the soft magnetic alloy powder having a large magnetic permeability and a small core loss, which is suitable for a magnetic core is obtained. However, at present, there is a demand for a magnetic core having smaller core loss.

[Patent Document 1] a brochure of JP-A-2000-30924

SUMMARY OF THE INVENTION

As a method of reducing core loss of the magnetic core, it is conceivable to reduce coercive force of the magnetic body constituting the magnetic core. Further, when cracks are generated by such as an impact, the cracks become pinning sites when moving magnetic domain walls, so that the magnetic core is required to have excellent toughness due to such as deterioration of soft magnetic properties.

Thus, an object of the present invention is to provide a soft magnetic alloy having low coercive force and excellent toughness.

To achieve the above object, the soft magnetic alloy of the invention of the first aspect is a soft magnetic alloy including Fe as a main component, in which the soft magnetic alloy includes $Fe_aCu_bM1_cSi_dB_eC_f$, wherein $a+b+c+d+e+f=100$, $0.0\leq b\leq 3.0$, $0.0\leq c\leq 10.0$, $0.0\leq d\leq 17.5$, $5.0\leq e\leq 13.0$, and $0.0\leq f\leq 7.0$, and M1 is one or more selected from a group composed of Nb, Ti, Zr, Hf, V, Ta, Mo, P and Cr, a slope of an approximate straight line, plotted between cumulative frequencies of 20 to 80% on Fe content (atom %) in each grid of 80000 grids or more, each of which has 1 nm×1 nm×1 nm, is −0.1 to −0.4, provided that Fe content (atom %) of each grid is Y axis, and the cumulative frequencies (%) obtained in descending order of Fe content in each grid is X axis, and an amorphization ratio X of the soft magnetic alloy represented by the following formula (1) is 85% or more.

$$X=100-(Ic/(Ic+Ia)\times 100) \quad (1)$$

Ic: crystalline scattering integrated intensity

Ia: amorphous scattering integrated intensity

The soft magnetic alloy of the invention according to the first aspect shows the above slope of the approximate straight line and amorphization ratio X within the above ranges respectively. Thus, the alloy has low coercive force and excellent toughness.

M1 content variation (σM1) is preferably 2.8 or more in the grid of 95% or more cumulative frequency (%) on Fe content.

To achieve the above object, the soft magnetic alloy of the invention of the second aspect is a soft magnetic alloy comprising Fe as a main component, in which the soft magnetic alloy includes $Fe_\alpha M2_\beta B_\gamma C_\Omega$, in which $\alpha+\beta+\gamma+\Omega=100$, $1.0\leq\beta\leq 20.0$, $2.0\leq\gamma\leq 20.0$ and $0.0\leq\Omega\leq 7.0$ and M2 is one or more selected from a group composed of Nb, Cu, Zr, Hf, Ti, V, Ta, Mo, P, Si and Cr, a slope of an approximate straight line, plotted between cumulative frequencies of 20 to 80% on Fe content (atom %) in each grid of 80000 grids or more, each of which has 1 nm×1 nm×1 nm, in a continuous measurement range of the soft magnetic alloy, is −0.1 to −0.4, provided that Fe content (atom %) of each grid is Y axis, and the cumulative frequencies (%) obtained in descending order of Fe content in each grid is X axis, and an amorphization ratio X of the soft magnetic alloy represented by the following formula (1) is 85% or more.

$$X=100-(Ic/(Ic+Ia)\times 100) \quad (1)$$

Ic: crystalline scattering integrated intensity

Ia: amorphous scattering integrated intensity

The soft magnetic alloy of the invention according to the second aspect shows the above slope of the approximate straight line within the above range and amorphization ratio X within the above range. Thus, the alloy has low coercive force and excellent toughness.

M2 content variation (σM2) is preferably 2.8 or more in the grid of 95% or more cumulative frequency (%) on Fe content.

The following description is common to the first and the second aspects of the invention.

The slope of the approximate straight line is preferably −0.1 to −0.2 and the amorphization ratio X of the formula (1) is preferably 95% or more.

C content in the soft magnetic alloy is preferably 0.1 to 7.0 atom %.

B content variation (σB) is preferably 2.8 or more in the grid of 95% or more cumulative frequency (%) on Fe content.

The magnetic device of the present invention includes the soft magnetic alloy.

DESCRIPTION OF THE PREFERRED EMBODIMENTS

Figure 1:
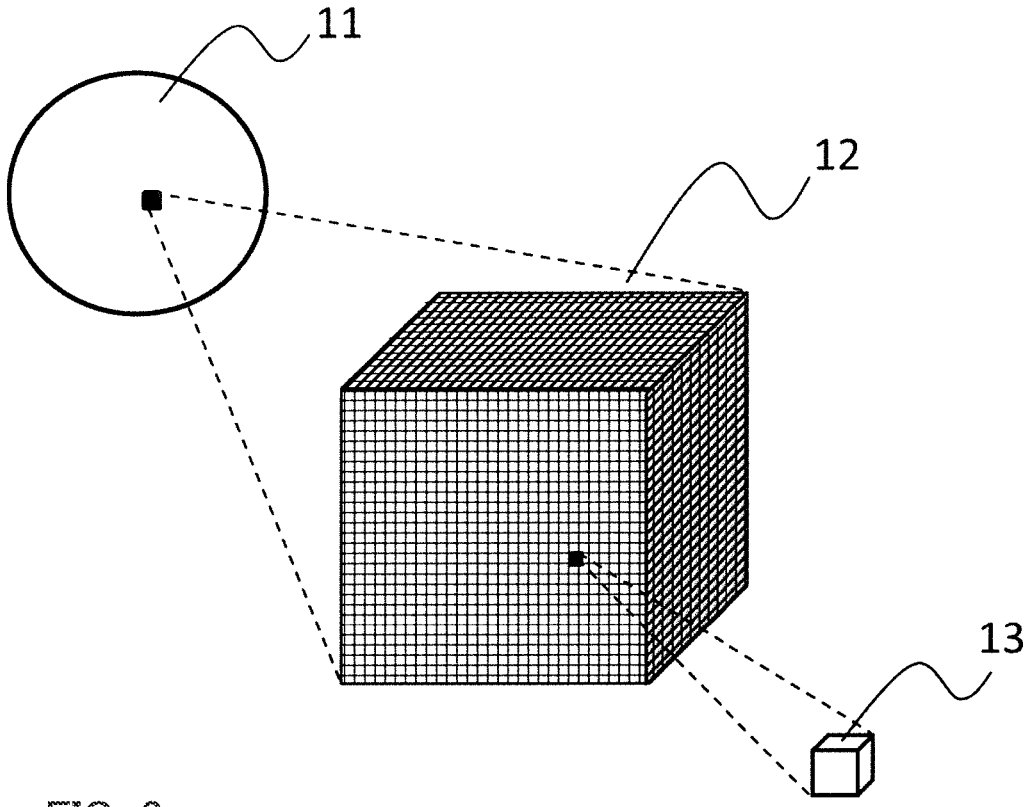
FIG. 1 is a schematic diagram showing the measurement range and grids according to an embodiment of the invention.

Hereinafter, the present invention is described based on embodiments of the invention.

The soft magnetic alloy according to the present embodiment is a soft magnetic alloy including Fe as a main component. "Fe as a main component" specifically refers to a soft magnetic alloy having Fe content of 65 atom % or more in the whole soft magnetic alloy.

The composition of the soft magnetic alloy according to the present embodiment is not particularly limited except that Fe is a main component and B is also a component. Fe—Si-M1-B—Cu—C based soft magnetic alloys and Fe-M2-B—C based soft magnetic alloys are exemplified, however, other soft magnetic alloys may be used.

In the following description, with respect to the content ratio of each element of the soft magnetic alloy, the whole soft magnetic alloy is determined 100 atom % in the absence of description of the population parameters in particular.

In case of using Fe—Si-M1-B—Cu—C based soft magnetic alloy, when said Fe—Si-M1-B—Cu—C based soft magnetic alloy includes FeaCubM1cSidBeCf, the following formula is satisfied. When the following formula is satisfied, it tends to be easy to obtain the soft magnetic alloy having a low coercive force and an excellent toughness. In addition, the soft magnetic alloy having the following composition is relatively inexpensive as a raw material. Fe—Si-M1-B—Cu—C based soft magnetic alloy according to the invention includes the soft magnetic alloy in which f=0, namely, C is not included.

$$a+b+c+d+e+f=100$$

$$0.1 \leq b \leq 3.0$$

$$1.0 \leq c \leq 10.0$$

$$0.0 \leq d \leq 17.5$$

$$6.0 \leq e \leq 13.0$$

$$0.0 \leq f \leq 7.0$$

Cu content ratio (b) is preferably 0.1 to 3.0 atom %, and more preferably 0.5 to 1.5 atom %. In addition, the smaller the Cu content ratio, the easier it is to prepare a ribbon including the soft magnetic alloy by a single roll method mentioned below.

M1 is a transition metal element or P. M1 may be one or more selected from the group consisting of Nb, Ti, Zr, Hf, V, Ta, Mo, P and Cr. M1 is preferably a transition metal element, more preferably one or more selected from the group consisting of Nb, Ti, Zr, Hf, V, Ta and Mo. Further, it is further preferable to include Nb as M.

M1 content ratio (c) is preferably 1.0 to 10.0 atom %, and more preferably 3.0 to 5.0 atom %. By adding M1 within the above range, coercive force can be lowered, and toughness can be improved.

Si content ratio (d) is preferably 0.0 to 17.5 atom %, more preferably 11.5 to 17.5 atom %, and further preferably 13.5 to 15.5 atom %. By adding Si within the above range, coercive force can be lowered, and toughness can be improved.

B content ratio (e) is preferably 6.0 to 13.0 atom %, and more preferably 9.0 to 11.0 atom %. By adding B within the above range, coercive force can be lowered, and toughness can be improved.

C content ratio (f) is preferably 0.0 to 7.0 atom %, more preferably 0.1 to 7.0 atom %, and further preferably 0.1 to 5.0 atom %. When C is added within the above range, coercive force can be lowered, and toughness can be improved.

It should be noted that Fe may be a remaining part of Fe—Si-M1-B—Cu—C based soft magnetic alloy according to this embodiment.

In the case of using Fe-M2-B—C based soft magnetic alloy, it is preferable to satisfy the following formula when the composition of Fe-M2-B—C based soft magnetic alloy is expressed as $Fe_{\alpha}M2_{\beta}B_{\gamma}C_{\Omega}$. When the following formula is satisfied, it tends to be easy to obtain the soft magnetic alloy having low coercive force and excellent toughness. In addition, raw material of the soft magnetic alloy having the following composition is relatively inexpensive. Fe-M2-B—C based soft magnetic alloy according to the invention includes the soft magnetic alloy in which Ω=0, namely, C is not included.

$$\alpha+\beta+\gamma+\Omega=100$$

$$1.0 \leq \beta \leq 20.0$$

$$2.0 \leq \gamma \leq 20.0$$

$$0.0 \leq \Omega \leq 7.0$$

M2 is a transition metal element or P. M2 may be one or more selected from the group consisting of Nb, Cu, Zr, Hf, Ti, V, Ta, Mo, P, Si and Cr. M2 is preferably a transition metal element, more preferably one or more selected from the group consisting of Nb, Cu, Zr, Hf, Ti, V, Ta, Mo, P and C, and further more preferably one or more selected from the group consisting of Nb, Cu, Zr, and Hf. It is further preferable that M2 includes one or more element selected from the group consisting of Nb, Zr and Hf.

M2 content ratio (β) is preferably 1.0 to 20.0 atom %, more preferably 1.0 to 14.1 atom %, and further more preferably 7.0 to 10.1 atom %.

B content ratio (γ) is preferably 2.0 to 20.0 atom %. Further, when Nb is included as M2, it is preferably 4.5 to 18.0 atom %, and when Zr and/or Hf is included as M2, 2.0 to 8.0 atom % is preferable. The smaller the B content ratio, the lower the amorphous property tends to be. When B content ratio is within the predetermined range, coercive force can be lowered, and toughness can be improved.

C content ratio (Ω) is preferably 0.0 to 7.0 atom %, more preferably 0.1 to 7.0 atom %, and more preferably 0.1 to 5.0 atom %. The addition of C tends to improve the amorphous property. When C content ratio is within the predetermined range, coercive force Hc can be lowered, and toughness can be improved.

Hereinafter, cumulative frequency (%) on Fe content and the slope of the approximate straight line of the soft magnetic alloy according to the embodiment will be described. In the following description, M is replaced with M1 when Fe—Si-M1-B—Cu—C based soft magnetic alloy is used, and M is replaced with M2 when Fe-M2-B—C based soft magnetic alloy is used. Similarly, σM is replaced with σM1 or σM2.

According to the soft magnetic alloy of the present embodiment, the slope of the approximate straight line, plotted between cumulative frequencies of 20 to 80% on Fe content (atom %) in each grid of 80000 grids or more, each of which has 1 nm×1 nm×1 nm, is −0.1 to −0.4, provided that Fe content (atom %) of each grid is Y axis, and the cumulative frequencies (%) obtained in descending order of Fe content in each grid is X axis.

Hereinafter, cumulative frequency (%) on Fe content and the slope of the approximate straight line of the soft magnetic alloy according to the embodiment will be described.

First, as shown in FIG. 1, a rectangular parallelepiped or a cubic having side lengths of at least 40 nm×40 nm×50 nm of soft magnetic alloy 11 is measurement range 12, and measurement range 12 of the rectangular parallelepiped or the cubic is divided into cubic grids 13 each having a side length of one nm. That is, 40×40×50=80,000 or more grids exist in one measurement range. With respect to the measurement range according to the present embodiment, the shape of the measurement range is not particularly limited, and it is sufficient when the final 80000 or more grids are present consecutively.

Next, Fe content (atom %) included in each grid 13 is evaluated using 3-dimensional atom probe (hereinafter, it may be expressed as 3DAP). Then, cumulative frequency (%) on Fe content in 80000 or more grids is calculated.

Figure 2:
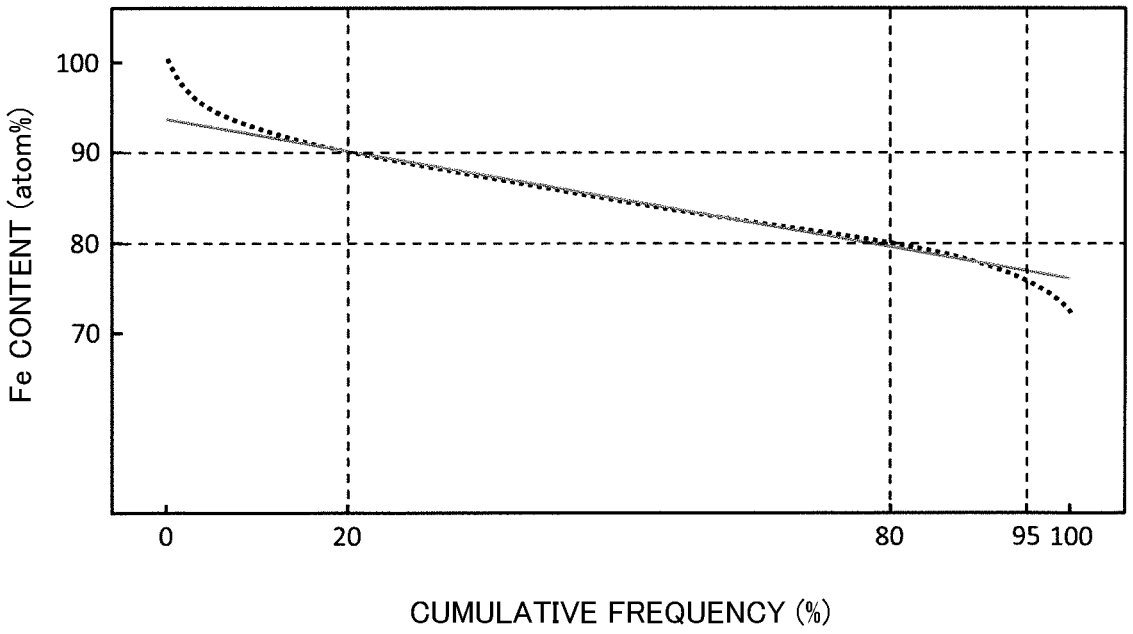
FIG. 2 is an example of a graph in which y-axis is Fe content (atom %) of the grid in the measurement range and x-axis is the accumulated frequency (%) obtained in descending order of the Fe content of each grid.

Here, the cumulative frequency (%) on Fe content is obtained as follows. First, the grid is divided for each Fe content. For example, the grid is arranged in descending order of Fe content. Next, the ratio (frequency) of number of grids in each content with respect to whole is calculated. The cumulative frequency (%) is the sum (cumulative sum) of frequencies from the first content (for example, the highest content) to each content in percentage (%). Graph such as FIG. 2 can be obtained when Fe content of the grid is plotted as y-axis and the accumulated frequency (%) obtained in descending order of the Fe content of each grid is plotted as x-axis. From the graph of FIG. 2, since Fe content of 90 atom % cumulative frequency is about 20%, the grid having the Fe content of 90 atom % or more is about 20% of the whole grids. Similarly, since the cumulative frequency of the Fe content of 80 atom % is about 80%, the grid having Fe content of 80 atom % or more is about 80% of the whole. According to the graph, the slope of the approximate straight line of the plot between cumulative frequencies of 20 to 80% was calculated. The smaller the absolute value of the slope, the smaller the variation of Fe content between grids. Then, by reducing the variation of Fe content among the grids, it becomes possible to obtain a soft magnetic alloy having reduced coercive force and excellent toughness.

The approximate straight line shows Fe content as Y axis and cumulative frequency (%) obtained in descending order of the Fe content of each grid as x axis, and perform linear approximation using least square method between the range of 20 to 80% cumulative frequency on Fe content.

According to the soft magnetic alloy of the present embodiment, when the slope of the approximate straight line, plotted between cumulative frequencies of 20 to 80% on Fe content (atom %) in each grid of 80000 grids or more, each of which has 1 nm×1 nm×1 nm, is −0.1 to −0.4, preferably −0.1 to −0.38, more preferably −0.1 to −0.35, and further preferably −0.1 to −0.2, provided that Fe content (atom %) of each grid is Y axis, and the cumulative frequencies (%) obtained in descending order of Fe content in each grid is X axis. By making the slope of the approximate straight line within the above range, a soft magnetic alloy having reduced coercive force and excellent toughness can be obtained.

the approximate straight line was made by the plot between the cumulative frequency of 20 to 80%. The plot in the cumulative frequency of less than 20% and more than 80% tends to greatly depart from the plot of approximate straight line in the cumulative frequency of 20 to 80%. Thus, it is intended to exclude the range.

In addition, in the soft magnetic alloy according to the present embodiment, when calculating cumulative frequency (%) on Fe content in 80000 or more grids as described above, B content variation σB in a grid having cumulative frequency of 95% or more, that is, in the grid whose cumulative frequency (%) is in the range of 95 to 100% is preferably 2.8 or more, more preferably 2.9 or more, and further preferably 3.0 or more. By setting B content variation σB within the above range, it is possible to obtain a soft magnetic alloy having reduced coercive force and excellent toughness. B content variation σB is calculated from B content measured using 3DAP.

In addition, in the soft magnetic alloy according to the present embodiment, when calculating cumulative frequency (%) on Fe content in 80000 or more grids as described above, M content variation σM in a grid having cumulative frequency of 95% or more is preferably 2.8 or more, more preferably 2.9 or more, and further preferably 3.0 or more. By setting M content variation σM within the above range, it is possible to obtain a soft magnetic alloy having reduced coercive force and excellent toughness. M content variation σM is calculated from M content measured using 3DAP. Here, M is preferably a transition metal element, more preferably one or more transition metal elements selected from the group composed of Nb, Cu, Zr and Hf, and further preferably one or more transition metal elements selected from the group composed of Nb, Zr and Hf.

By performing the measurement described above several times in different measurement ranges, the accuracy of the calculated result may be made sufficiently high. Preferably, measurement is performed three or more times in different measurement ranges.

According to the soft magnetic alloy of the present embodiment, the slope of the approximate straight line, plotted between cumulative frequencies of 20 to 80% on Fe content (atom %) is −0.1 to −0.4, provided that Fe content (atom %) of each grid is Y axis, and the cumulative frequencies (%) obtained in descending order of Fe content in each grid is X axis, and amorphization ratio X represented by the following formula (1) is 85% or more, preferably 90% or more, more preferably 95% or more, further preferably 96% or more, and particularly preferably 98% or more. By making amorphization ratio X within the above range, it is possible to obtain a soft magnetic alloy having reduced coercive force and excellent toughness.

$$X=100-(Ic/(Ic+Ia)\times 100) \quad (1)$$

Ic: crystalline scattering integrated intensity

Ia: amorphous scattering integrated intensity

The amorphization ratio X is a value obtained by performing X-ray crystal structure analysis by XRD, identifying the phase, the peak of crystallized Fe or compound (Ic: crystalline scattering integrated intensity, Ia: amorphous scattering integral intensity) is read, the crystallization rate is determined from the peak intensity, and is calculated by the above formula (1). Specifically, it is obtained as following.

Figure 3:
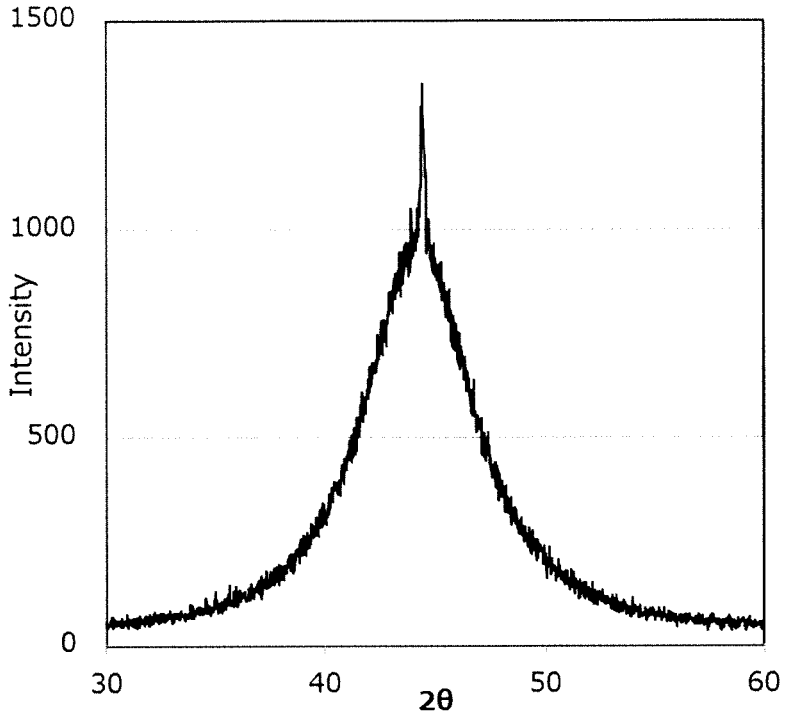
FIG. 3 is an example of a chart obtained by X-ray crystal structure analysis.
Figure 4:
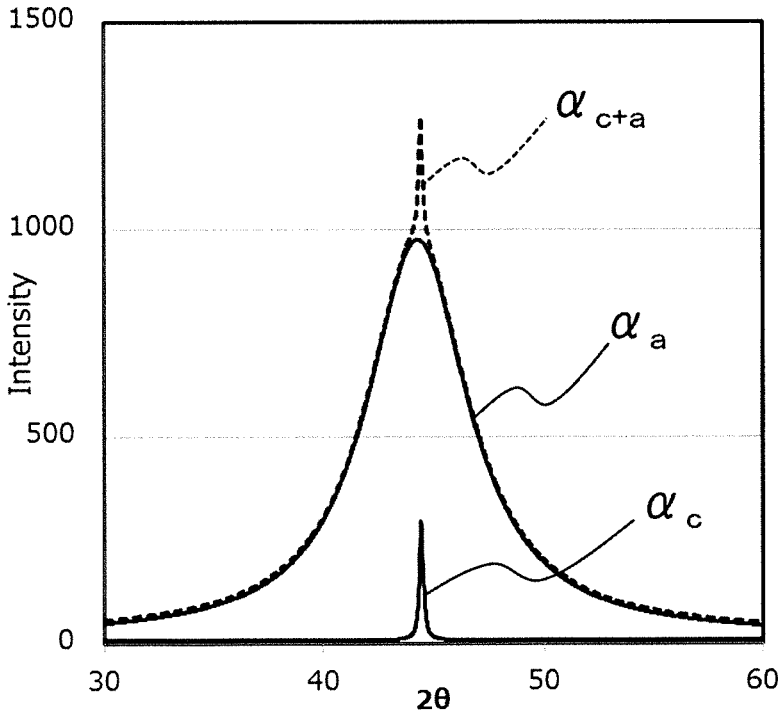
FIG. 4 is an example of a pattern obtained by profile fitting the chart of FIG. 3.

The soft magnetic alloy according to the present embodiment is subjected to X-ray crystal structure analysis by XRD to obtain a chart as shown in FIG. 3. This was subjected to profile fitting using the Lorenz function of the following formula (2), and the pattern $\alpha_c$ of the crystalline component showing the crystalline scattering integrated intensity, the pattern $\alpha_a$ of the crystalline component showing the amorphous scattering integrated intensity, and a pattern $\alpha_{c+a}$ obtained by combining the pattern $\alpha_c$ and $\alpha_a$, respectively shown in FIG. 4 were obtained. From the crystalline scattering integrated intensity and the amorphous scattering integrated intensity of the obtained pattern, the amorphization ratio X is obtained by the above formula (1). The measurement range is the range of the diffraction angle 2θ=30° to 60° at which an amorphous derived halo can be confirmed. In this range, the error between the measured integral intensity by XRD and the integral intensity calculated using Lorenz function is made to be within 1%.

$$f(x) = \frac{h}{1 + \frac{(x-u)^2}{w^2}} + b \quad \text{(Equation 1)}$$

h: peak height
u: peak position
w: half width
b: background height

In the present embodiment, in the case where the soft magnetic alloy is obtained in a ribbon shape by a single roll method described later, the average value of the amorphization ratio $X_A$ on the surface in contact with the roll surface and the amorphous ratio $X_B$ in the surface not in contact with the roll surface is determined as the amorphization ratio X.

According to the soft magnetic alloy of the present embodiment, by setting the slope of the above approximate straight line to −0.1 to −0.4 and amorphization ratio X shown in the above formula (1) to 85% or more, that is, when variation of Fe content between grids is small and the soft magnetic alloy is highly amorphous, coercive force Hc is lowered and the toughness is improved.

Toughness means sensitivity or resistance to fracture. In the present embodiment, the toughness is evaluated by a 180-degree adhesion test. Specifically, the 180-degree adhesion test is a 180° bending test, and the sample is bent so that the bending angle is 180° and the inner radius is zero. According to the present embodiment, in a 180° bending test in which a 3 cm long ribbon sample is bent at its center and evaluated by whether the sample can be closely bent.

According to the soft magnetic alloy of the present embodiment, it is preferable that the slope of the approximate straight line is −0.1 to −0.2 and amorphization ratio X shown in the above formula (1) is 95% or more. Such soft magnetic alloy is obtainable when the latter mentioned heat treatment is not performed. By setting the slope of the approximate straight line and amorphization ratio X shown in the above formula (1) respectively to the above ranges, coercive force Hc is lowered and the toughness is improved.

According to the soft magnetic alloy of the present embodiment, it is preferable to include C. C content is preferably 0.0 to 7.0 atom %, more preferably 0.1 to 7.0 atom %, and further preferably 0.1 to 5.0 atom %. By setting C content within the above range, coercive force Hc is lowered and the toughness is improved.

According to the soft magnetic alloy of the present embodiment, it is preferable to include B. B content variation σB in a grid having cumulative frequency of 95% or more on Fe content is preferably 2.8 or more, more preferably 2.9 or more, and further preferably 3.0 or more. By setting B content variation σB within the above range, it is possible to reduce coercive force and improve toughness.

According to the soft magnetic alloy of the present embodiment, it is preferable to include M. M content variation σM in a grid having cumulative frequency of 95% or more on Fe content is preferably 2.8 or more, more preferably 2.9 or more, and further preferably 3.0 or more. By setting M content variation σM within the above range, it is possible to reduce coercive force and improve toughness.

M is preferably a transition metal element, more preferably one or more selected from the group composed of Nb, Cu, Zr and Hf, and further preferably one or more selected from the group composed of Nb, Zr and Hf, Hereinafter, a method of preparing the soft magnetic alloy according to the present embodiment will be described The method of preparing the soft magnetic alloy according to the present embodiment is not particularly limited. For example, there is a method of preparing a ribbon of a soft magnetic alloy by such as a single roll method.

According to the single roll method, first, pure metals of each metal element included in the finally obtained soft magnetic alloy are prepared and weighed to have the same composition as the finally obtained soft magnetic alloy. Then, pure metals of each metal element are dissolved and mixed to prepare a mother alloy. There is no particular limitation on the method of dissolving the pure metal, but for example, there is a method of dissolving the pure metal by high-frequency heating after vacuum evacuation in the chamber. Incidentally, the mother alloy and the finally obtained soft magnetic alloy usually have the same composition.

Next, the prepared mother alloy is heated and melted to obtain molten metal (bathing). The temperature of the molten metal is not particularly limited, but may be, for example, 1200 to 1500° C.

Figure 5:
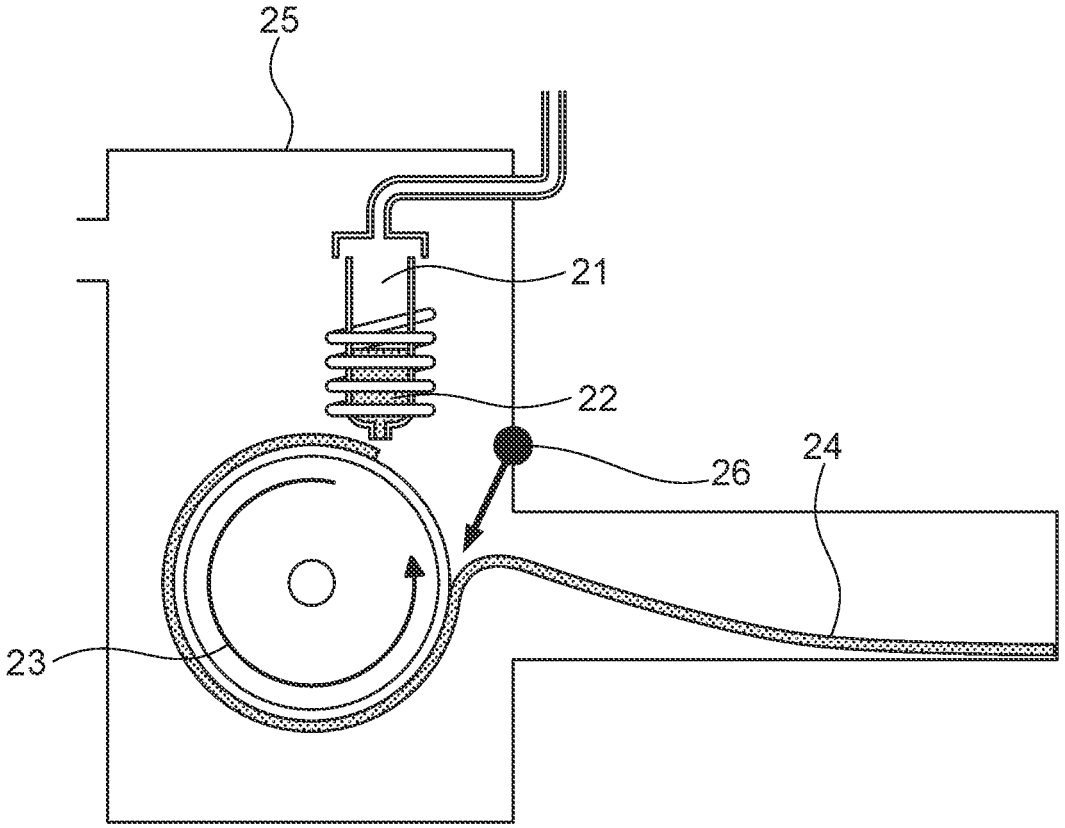
FIG. 5 is a schematic diagram of a single roll method.

A schematic diagram of an apparatus used for the single roll method is shown in FIG. 5. In the single roll method according to the present embodiment, molten metal 22 is injected and supplied from nozzle 21 to roll 23, rotating in the arrow direction, so that ribbon 24 is prepared in the rotational direction of roll 23. In this embodiment, the material of roll 23 is not particularly limited. For example, a roll including Cu is used.

Conventionally, in the single roll method, it was considered preferable to increase the cooling rate and rapidly cool molten metal 22. It was also considered preferable that increasing the temperature difference between molten metal 22 and roll 23 can improve the cooling rate. Thus, as shown in FIG. 5, the inventors found that by rotating in the direction opposite to the general rotational direction of the roll, the time during which roll 23 and ribbon 24 contact becomes long, and ribbon 24 can be rapidly cooled.

Further, as an advantage of rotating roll 23 in the direction shown in FIG. 5, it is possible that the strength of cooling by roll 23 can be controlled by controlling gas pressure of the peel gas injected from peel gas injector 26 shown in FIG. 5. For example, by increasing gas pressure of the peel gas, it is possible to shorten the time during which roll 23 and ribbon 24 are in contact and to weaken the cooling. Conversely, weakening gas pressure of the peel gas makes it possible to lengthen the time during which roll 23 and ribbon 24 are in contact, and to strengthen the cooling.

In the single roll method, it is possible to adjust the thickness of the ribbon obtained by mainly adjusting the rotational speed of roll 23. However, for example, it is possible to adjust the thickness of the obtained ribbon by adjusting a gap between nozzle 21 and roll 23, the temperature of the molten metal, etc. Thickness of the obtained ribbon is not particularly limited, but it may be 15 to 30 μm.

The temperature of roll 23 and the vapor pressure inside chamber 25 are not particularly limited. For example, the temperature of roll 23 may be set to 50 to 70° C. and the vapor pressure inside chamber 25 may be set to 11 hPa or less by using Ar gas in which dew point has been adjusted.

Conventionally, in the single roll method, it was considered preferable to increase the cooling rate and rapidly cool molten metal 22. It was also considered preferable that increasing the temperature difference between molten metal 22 and roll 23 can improve the cooling rate. Therefore, it was generally thought that the temperature of roll 23 is preferably approximately 5 to 30° C. However, the present inventors have found that, by setting the temperature of roll 23 to 50 to 70° C., which is higher than that of conventional single roll method, and further setting the vapor pressure inside chamber 25 to 11 hPa or less, it was found that molten metal 22 is evenly cooled, and the ribbon before heat treatment of the obtained soft magnetic alloy can be made uniform amorphous. The lower limit of vapor pressure inside the chamber is not particularly limited. The vapor pressure may be one hPa or less by filling dew point adjusted argon or the vapor pressure may be one hPa or less as a state close to vacuum.

Thus, obtained soft magnetic alloy may be heat treated. The heat treatment conditions are not particularly limited. Preferable heat treatment conditions differ depending on the composition of the soft magnetic alloy. Generally, preferable heat treatment temperature is approximately 550 to 600° C. and preferable heat treatment time is 10 to 180 minutes. However, there may exist a preferable heat treatment temperature and a heat treatment time outside the above range, depending on the composition.

A method of obtaining the soft magnetic alloy according to the embodiment is not limited to the single roll method. Powder of the soft magnetic alloy according to the embodiment may be obtained by a water atomizing method or a gas atomizing method.

For instance, according to the gas atomizing method, a molten alloy of 1200 to 1500° C. is obtained in the same manner as the above single roll method. Thereafter, the molten alloy is injected in the chamber to prepare a powder. During the time, it is preferable that the gas injection temperature is 50 to 100° C. and the vapor pressure in the chamber is four hPa or less. Heat treatment may be carried out at 550 to 650° C. for 10 to 180 minutes after preparing the powder by gas atomizing method.

Although one embodiment of the present invention has been described above, the present invention is not limited to the above embodiment.

The shape of the soft magnetic alloy according to the present embodiment is not particularly limited. As described above, a ribbon shape or powder shape is exemplified, and in addition, a block shape, etc. are also conceivable.

The application of the soft magnetic alloy according to the present embodiment is not particularly limited and can be suitably applied to the magnetic devices. A magnetic core can be exemplified as the magnetic devices. The soft magnetic alloy according to the present embodiment can be suitably used as a magnetic core for an inductor, particularly for a power inductor. In addition to the magnetic core, the soft magnetic alloy according to the present embodiment can also be suitably used for the magnetic devices such as a thin film inductor, a magnetic head, and a transformer.

In particular, since the soft magnetic alloy according to the present embodiment is also excellent in toughness, and it can also be suitably used for a high-pressure dust core.

Hereinafter, a method of obtaining the magnetic core and the inductor from the soft magnetic alloy according to the present embodiment will be described, but the method of obtaining the magnetic core and the inductor from the soft magnetic alloy according to the present embodiment is not limited to the following method.

As a method for obtaining a magnetic core from a ribbon shaped soft magnetic alloy, for example, a method of winding a ribbon shaped soft magnetic alloy or a method of laminating the same can be mentioned. In case of laminating the ribbon shaped soft magnetic alloys via an insulator at the time of lamination, it is possible to obtain a magnetic core with further improved properties.

As a method for obtaining the magnetic core from the soft magnetic alloy of a powdery state, pressing method using a press mold after mixing with an appropriate binder is exemplified. Also, by subjecting an oxidation treatment, an insulating coating, etc. to the powder surface before mixing with the binder, specific resistance improves, and it becomes a magnetic core suitable for a higher frequency band.

Pressing method is not particularly limited, and a pressing, a mold pressing, etc. using the press mold is exemplified. Kind of binder is not particularly limited, and silicone resins are exemplified. A mixing ratio of the soft magnetic alloy powder and binder is not particularly limited. For example, 1 to 10 mass % of binder is mixed with 100 mass % of the soft magnetic alloy powder.

For example, by mixing 1 to 5 mass % of binder with 100 masses % of the soft magnetic alloy powder and performing compression molding using the press mold, a magnetic core having a space factor (powder filling rate) of 70% or more, magnetic flux density of 0.4 T or more when a magnetic field of $1.6\times10^4$ A/m is applied and specific resistance of one Ω·cm or more can be obtained. The above characteristics are superior to general ferrite magnetic cores.

Further, for example, by mixing 1 to 3 mass % of binder with 100 mass % of the soft magnetic alloy powder and performing compression molding using the press mold under a temperature condition not lower than the softening point of the binder, a magnetic core having a space factor of 80% or more, magnetic flux density of 0.9 T or more when a magnetic field of $1.6\times10^4$ A/m is applied and specific resistance of 0.1 Ω·cm or more can be obtained. The above characteristics are superior to general ferrite magnetic cores.

Furthermore, by subjecting a green compact forming the above magnetic core to heat treatment after pressing as strain relieving heat treatment, the core loss further decreases and the usefulness is enhanced.

Inductance components can be obtained by applying wire on the above magnetic core. Methods to prepare the wire and to prepare inductance components are not particularly limited. For example, a method of winding the wire around the magnetic core prepared by the above method for at least one turn can be exemplified.

In case when soft magnetic alloy particles are used, there is a method of preparing inductance components by pressing and integrating a state in which a winding coil is stored in a magnetic material. In this case, it is easy to obtain an inductance component corresponding to high frequency and large current.

Furthermore, in the case of using soft magnetic alloy particles, a soft magnetic alloy paste, in which binder and solvent are added to the soft magnetic alloy and pasted thereof, and a conductive paste, in which binder and solvent are added to the conductor metal for the coil, are alternatively printed and laminated, then heated and fired, and an inductance component can be obtained. Alternatively, a soft magnetic alloy sheet is prepared by using a soft magnetic alloy paste, a conductor paste is printed on the surface of the soft magnetic alloy sheet, and they were laminated and fired, whereby an inductance component in which a coil is stored in a magnetic body can be obtained.

In case of preparing an inductance component using soft magnetic alloy particles, it is preferable to use the soft magnetic alloy powder having a maximum grain diameter of 45 μm or less and a center grain diameter (D50) of 30 μm or less, in terms of sieve diameter, to obtain superior Q characteristics. To make the maximum grain diameter 45 μm or less in terms of sieve diameter, a sieve with a mesh size of 45 μm may be used, and only the soft magnetic alloy powder passing through the sieve may be used.

As the soft magnetic alloy powder having a large maximum grain diameter is used, the Q value in a high frequency area tends to decrease. Particularly, in case of using the soft magnetic alloy powder having a maximum grain diameter exceeding 45 μm, in terms of sieve diameter, Q value may decrease greatly in high frequency area. However, when Q value in high frequency area is not valued, it is possible to use a soft magnetic alloy powder having large variations. Since soft magnetic alloy powder having large variations can be produced with a relatively low cost, it is possible to reduce the cost when soft magnetic alloy powder with large variation is used.

EXAMPLE

Hereinafter, the present invention will be specifically described based on examples.

(Experiment 1)

Pure metal materials were each weighed so that a mother alloy having the composition of each sample shown in Table 1 was obtained. After vacuum evacuation in the chamber, pure metal materials were melted by high frequency heating and prepared the mother alloy.

Thereafter, 50 g of the prepared mother alloy was heated and melted to obtain a metal in a molten state at 1300° C. Then the above metal was injected onto a roll by a single roll method shown in FIG. 5 under a specified roll temperature and a specified steam pressure and formed a ribbon. The material of the roll was Cu. The single roll method was performed under Ar atmosphere, rotational speed of the roll at 25 m/s, differential pressure between inside the chamber and inside the injection nozzle of 105 kPa, 5 mm slit nozzle diameter, flow amount of 50 g, and roll diameter of φ 300 mm, and obtained a ribbon having a thickness of 20 to 30 μm, a width of four to five mm, and a length of several tens of meters.

In Experiment 1, temperature of the roll was set 50° C. and vapor pressure was set to four hPa, and then peel injection pressure (rapid cooling ability) was varied and prepared each sample shown in Table 1. The vapor pressure was adjusted by using Ar gas with dew point adjustment.

The following evaluations were performed to the obtained ribbon formed sample. Results are shown in Table 1.

(1) Slope of Approximate Straight Line

In the obtained ribbon, a rectangular parallelepiped having a side length of 40 nm×40 nm×50 nm was used as a measuring range. Fe content in 80000 pieces of the grid having 1 nm×1 nm×1 nm in a continuous measurement range was measured by 3DAP. The slope of the approximate straight line between cumulative frequencies of 20 to 80% was calculated, provided that Fe content (atom %) is Y axis, and the cumulative frequencies (%) obtained in descending order of Fe content in each grid is X axis.

(2) Coercive Force Hc

Coercive force Hc was measured using an Hc meter. Coercive force Hc of 45 A/m or less was determined preferable.

(3) Amorphization Ratio X

X-ray crystal structure analysis by XRD was performed to the obtained ribbon and the phase was identified. Specifically, the peak of crystallized Fe or compound (Ic: crystalline scattering integrated intensity, Ia: amorphous scattering integral intensity) is read, the crystallization rate is determined from the peak intensity, and amorphization ratio X is calculated by the above formula (1). According to the present example, the ribbon surface in contact with the roll surface and the ribbon surface not in contact with the roll surface were both measured and an average value thereof was determined amorphization ratio X.

$$X=100-(Ic/(Ic+Ia)\times 100) \quad (1)$$

Ic: crystalline scattering integrated intensity

Ia: amorphous scattering integrated intensity (4) 180 Degree Adhesion Test

In the 180-degree adhesion test, it was evaluated by 180° bending test. 180° bending test is a test for evaluating toughness, in which the sample is bent so that the bending angle becomes 180° and the inner radius becomes zero. In the present example, the 180° bending test in which ten ribbon samples each having a length of 3 cm were prepared and bent at the center thereof was performed. It was determined excellent when all the samples were tightly bent, good when 7 to 9 samples were tightly bent, and poor when four or more samples were broken.

TABLE 1

| Sample No. | Ex. or Comp. Ex. | Composition | Peel Injection Pressure (MPa) | Slope | Coercive force Hc (A/m) | Amorphization Ratio (%) | 180 Degree Adhesion Test |
|---|---|---|---|---|---|---|---|
| 1 | Ex. | $Fe_{84}Nb_7B_9$ | 0.4 | −0.102 | 12 | 96.3 | ○ |
| 2 | Ex. | $Fe_{84}Nb_7B_9$ | 0.3 | −0.101 | 23 | 98.4 | ○ |
| 3 | Comp. Ex. | $Fe_{84}Nb_7B_9$ | 0.2 | −0.94 | 190 | 100 | ○ |
| 4 | Ex. | $Fe_{85}Nb_6B_9$ | 0.4 | −0.2 | 19 | 91 | ○ |
| 5 | Ex. | $Fe_{86}Nb_5B_9$ | 0.4 | −0.34 | 35 | 85 | Δ |
| 6 | Ex. | $Fe_{87}Nb_4B_9$ | 0.2 | −0.38 | 44 | 87 | Δ |
| 7 | Comp. Ex. | $Fe_{87}Nb_4B_9$ | 0.3 | −0.4 | 583 | 53 | X |
| 8 | Comp. Ex. | $Fe_{87}Nb_4B_9$ | 0.4 | −0.52 | 1230 | 45 | X |

From the results in Table 1, all the examples in which slope of approximate straight line was −0.1 to −0.4 and amorphization ratio X was 85% or more showed preferable coercive force Hc. In contrast, all the comparative examples in which slope of approximate straight line exceeded −0.4 or the amorphization ratio X was less than 85% did not show preferable coercive force Hc. In examples 1 to 3 in which slope of approximate straight line was −0.1 to −0.2 and amorphization ratio X was 95% or more, Hc was more preferable.

(Experiment 2)

Tests were conducted under the same conditions as in Experiment 1 except that composition of the soft magnetic alloy was varied. Results are shown in Table 2.

TABLE 2

| Sample No. | Ex. or Comp. Ex. | Composition | Peel Injection Pressur | Slope | Coercive force Hc (A/m) | Amorphization Ratio (%) | 180 Degree Adhesion Test |
|---|---|---|---|---|---|---|---|
| 9 | Ex. | $(Fe_{84}Nb_7B_9)_{99.9}C_{0.1}$ | 0.3 | −0.123 | 9 | 98.7 | Excellent |
| 10 | Ex. | $(Fe_{84}Nb_7B_9)_{99.5}C_{0.5}$ | 0.3 | −0.104 | 7 | 98.5 | Excellent |
| 11 | Ex. | $(Fe_{84}Nb_7B_9)_{99.0}C_{1.0}$ | 0.3 | −0.105 | 1.3 | 98.3 | Excellent |
| 12 | Ex. | $(Fe_{84}Nb_7B_9)_{97.0}C_{3.0}$ | 0.3 | −0.115 | 5 | 98.9 | Excellent |
| 13 | Ex. | $(Fe_{84}Nb_7B_9)_{95.0}C_{5.0}$ | 0.3 | −0.115 | 12 | 98.3 | Excellent |
| 14 | Ex. | $(Fe_{84}Nb_7B_9)_{93.0}C_{7.0}$ | 0.3 | −0.15 | 24 | 91.2 | Good |

From the results in Table 2, all the examples in which slope of approximate straight line was −0.1 to −0.4, amorphization ratio X was 85% or more, and C content was 0.1 to 7.0 atom % showed preferable coercive force Hc.

(Experiment 3)

Tests were conducted under the same conditions as in Experiment 1 except that composition of the soft magnetic alloy was varied, the following evaluations were made and peel injection pressure was 0.3 Mpa. Results are shown in Table 3.

(5) B(σ)

In the obtained ribbon, a rectangular parallelepiped having a side length of 40 nm×40 nm×50 nm was used as a measuring range, and cumulative frequency (%) on Fe content in 80000 pieces of the grid having 1 nm×1 nm×1 nm in a continuous measurement range was calculated. B content of the grid showing cumulative frequency of 95% or more was measured, and B content variation (σB) was calculated. Fe content and B content were measured by 3DAP.

(6) M(σ)

In the obtained ribbon, a rectangular parallelepiped having a side length of 40 nm×40 nm×50 nm was used as a measuring range, and cumulative frequency (%) on Fe content in 80000 pieces of the grid having 1 nm×1 nm×1 nm in a continuous measurement range was calculated. M content (a total content of Nb, Zr and Hf) of the grid showing cumulative frequency of 95% or more was measured, and M content variation (σM) was calculated. Fe content and M content were measured by 3DAP.

TABLE 3

| Sample No. | Ex. or Comp. Ex. | Composition | Slope | Coercive force Hc (A/m) | Amorphization Ratio (%) | 180 Degree Adhesion Test | B (σ) | M (σ) |
|---|---|---|---|---|---|---|---|---|
| 15 | Ex. | $Fe_{84}Nb_7B_9$ | −0.101 | 23 | 98 | Excellent | 2.95 | 2.55 |
| 16 | Ex. | $(Fe_{84}Nb_7B_9)_{99.5}C_{0.5}$ | −0.104 | 7 | 99 | Excellent | 3.02 | 3.02 |
| 17 | Ex. | $(Fe_{84}Nb_7B_9)_{99.0}C_{1.0}$ | −0.105 | 1.3 | 98 | Excellent | 3.03 | 3.04 |
| 18 | Ex. | $(Fe_{84}Nb_7B_9)_{98.0}C_{3.0}$ | −0.117 | 5 | 99 | Excellent | 3.3 | 3.43 |
| 19 | Comp. Ex. | $Fe_{88}Nb_3B_9$ | — | 15800 | 2 | Poor | — | — |
| 20 | Ex. | $Fe_{86}Nb_5B_9$ | −0.104 | 24 | 92 | Good | 2.99 | 2.67 |
| 21 | Ex. | $Fe_{81}Nb_{10}B_9$ | −0.113 | 18 | 96 | Excellent | 2.92 | 2.91 |
| 22 | Comp. Ex. | $Fe_{77}Nb_{14}B_9$ | −0.093 | 83 | 100 | Excellent | 2.44 | 1.89 |
| 23 | Comp. Ex. | $Fe_{90}Nb_7B_3$ | — | 20000 | 34 | Poor | — | — |
| 24 | Ex. | $Fe_{87}Nb_7B_6$ | −0.108 | 16 | 87 | Good | 2.83 | 2.98 |
| 25 | Ex. | $Fe_{84}Nb_7B_9$ | −0.111 | 6.6 | 98 | Excellent | 2.98 | 3.1 |
| 26 | Ex. | $Fe_{81}Nb_7B_{12}$ | −0.101 | 5.88 | 99 | Excellent | 2.81 | 2.84 |
| 27 | Comp. Ex. | $Fe_{75}Nb_7B_{18}$ | −0.094 | 75 | 100 | Excellent | 2.55 | 2.66 |
| 28 | Ex. | $Fe_{83.9}Cu_{0.1}Nb_7B_9$ | −0.104 | 15 | 96 | Excellent | 3.01 | 2.98 |
| 29 | Ex. | $Fe_{83}Cu_2Nb_7B_9$ | −0.112 | 25 | 85 | Good | 2.84 | 2.95 |
| 30 | Comp. Ex. | $Fe_{81}Cu_3Nb_7B_9$ | — | 18000 | 21 | Poor | — | — |
| 31 | Ex. | $Fe_{85.9}Cu_{0.1}Nb_5B_9$ | −0.111 | 28 | 85 | Good | 2.95 | 2.78 |
| 32 | Ex. | $Fe_{83.9}Cu_{0.1}Nb_7B_9$ | −0.109 | 10 | 90 | Good | 2.94 | 2.87 |
| 33 | Ex. | $Fe_{80.9}Cu_{0.1}Nb_{10}B_9$ | −0.104 | 14 | 95 | Excellent | 2.81 | 2.86 |
| 34 | Comp. Ex. | $Fe_{76.9}Cu_{0.1}Nb_{14}B_9$ | −0.082 | 90 | 100 | Excellent | 1.96 | 1.95 |
| 35 | Comp. Ex. | $Fe_{89.9}Cu_{0.1}Nb_7B_3$ | — | 16000 | 10 | Poor | — | — |
| 36 | Ex. | $Fe_{88.4}Cu_{0.1}Nb_7B_{4.5}$ | −0.121 | 17 | 86 | Good | 3.14 | 2.99 |
| 37 | Ex. | $Fe_{83.9}Cu_{0.1}Nb_7B_9$ | −0.109 | 10 | 90 | Good | 2.94 | 2.87 |
| 38 | Ex. | $Fe_{80.9}Cu_{0.1}Nb_7B_{12}$ | −0.105 | 12 | 96 | Excellent | 2.83 | 2.92 |
| 39 | Comp. Ex. | $Fe_{74.9}Cu_{0.1}Nb_7B_{18}$ | −0.084 | 123 | 99 | Excellent | 2.25 | 2.56 |
| 40 | Ex. | $Fe_{91}Zr_7B_2$ | −0.113 | 8.2 | 90 | Good | 4.23 | 2.95 |
| 41 | Ex. | Fe90Zr7B3 | −0.115 | 4.3 | 96 | Excellent | 3.35 | 2.97 |
| 42 | Ex. | Fe89Zr7B3Cu1 | −0.115 | 4.8 | 92 | Good | 3.65 | 2.91 |
| 43 | Ex. | Fe90Hf7B3 | −0.103 | 6.14 | 86 | Good | 3.35 | 2.95 |
| 44 | Ex. | Fe89Hf7B4 | −0.104 | 4.9 | 87 | Good | 3.02 | 2.98 |
| 45 | Ex. | Fe88Hf7B3Cu1 | −0.108 | 12.4 | 85 | Good | 3.34 | 2.99 |
| 46 | Ex. | Fe84Nb3.5Zr3.5B8Cu1 | −0.106 | 2.3 | 95 | Excellent | 3.01 | 2.89 |
| 47 | Ex. | Fe84Nb3.5Hf3.5B8Cu1 | −0.108 | 2.4 | 94 | Excellent | 3.02 | 2.91 |
| 48 | Ex. | Fe90.9Nb6B3C0.1 | −0.123 | 7.8 | 87 | Good | 3.21 | 3.61 |
| 49 | Ex. | Fe93.06Nb2.97B2.97C1 | −0.134 | 9.8 | 86 | Good | 3.25 | 3.21 |
| 50 | Comp. Ex. | Fe94.05Nb1.98B2.97C1 | — | 199 | 34 | Poor | — | — |
| 51 | Ex. | Fe90.9Nb1.98B2.97C4 | −0.107 | 23 | 88 | Good | 3.21 | 3.62 |
| 55 | Ex. | Fe80.8Nb6.7B8.65C3.85 | −0.107 | 3.98 | 96 | Excellent | 2.84 | 2.91 |
| 56 | Ex. | $Fe_{77.9}Nb_{14}B_8C_{0.1}$ | −0.104 | 28 | 99 | Excellent | 2.86 | 2.56 |

TABLE 3-continued

| Sample No. | Ex. or Comp. Ex. | Composition | Slope | Coercive force Hc (A/m) | Amorphization Ratio (%) | 180 Degree Adhesion Test | B (σ) | M (σ) |
|---|---|---|---|---|---|---|---|---|
| 57 | Comp. Ex. | $Fe_{75}Nb_{13.5}B_{7.5}C_4$ | −0.097 | 173 | 99 | Excellent | 2.34 | 2.56 |
| 58 | Comp. Ex. | $Fe_{78}Nb_1B_{17}C_4$ | −0.089 | 148 | 99 | Excellent | 2.31 | 2.34 |
| 59 | Comp. Ex. | $Fe_{78}Nb_1B_{20}C_1$ | −0.078 | 183 | 100 | Excellent | 2.31 | 2.43 |
| 60 | Ex. | $Fe_{77.5}Cu_1Nb_3Si_{13.5}B_5$ | −0.121 | 16 | 87 | Good | 3.12 | 2.45 |
| 61 | Ex. | $Fe_{75.5}Cu_1Nb_3Si_{13.5}B_7$ | −0.107 | 5 | 92 | Good | 2.99 | 2.98 |
| 62 | Ex. | $Fe_{73.5}Cu_1Nb_3Si_{13.5}B_9$ | −0.104 | 3 | 95 | Excellent | 2.84 | 2.89 |
| 63 | Ex. | $Fe_{71.5}Cu_1Nb_3Si_{13.5}B_{11}$ | −0.101 | 7 | 98 | Excellent | 2.81 | 2.84 |
| 64 | Comp. Ex. | $Fe_{69.5}Cu_1Nb_3Si_{13.5}B_{13}$ | −0.089 | 178 | 100 | Excellent | 2.2 | 2.13 |
| 65 | Ex. | $Fe_{74.5}Nb_3Si_{13.5}B_9$ | −0.115 | 17 | 88 | Good | 2.84 | 2.56 |
| 66 | Comp. Ex. | $Fe_{74.4}Cu_{0.1}Nb_3Si_{13.5}B_9$ | −0.094 | 120 | 100 | Excellent | 2.35 | 2.43 |
| 67 | Ex. | $Fe_{73.5}Cu_1Nb_3Si_{13.5}B_9$ | −0.104 | 3 | 95 | Excellent | 2.84 | 2.89 |
| 68 | Ex. | $Fe_{71.5}Cu_3Nb_3Si_{13.5}B_9$ | −0.103 | 43 | 100 | Excellent | 2.2 | 2.14 |
| 70 | Ex. | $Fe_{79.5}Cu_1Nb_3Si_{9.5}B_9$ | −0.114 | 14 | 97 | Excellent | 2.83 | 2.45 |
| 71 | Ex. | $Fe_{75.5}Cu_1Nb_3Si_{11.5}B_9$ | −0.106 | 13 | 95 | Excellent | 2.86 | 2.33 |
| 73 | Ex. | $Fe_{73.5}Cu_1Nb_3Si_{15.5}B_7$ | −0.101 | 15 | 93 | Excellent | 2.88 | 2.65 |
| 74 | Ex. | $Fe_{71.5}Cu_1Nb_3Si_{15.5}B_9$ | −0.102 | 12 | 95 | Excellent | 2.84 | 2.91 |
| 75 | Comp. Ex. | $Fe_{69.5}Cu_1Nb_3Si_{17.5}B_9$ | −0.084 | 137 | 100 | Excellent | 2.43 | 2.22 |
| 76 | Ex. | $Fe_{76.5}Cu_1Si_{13.5}B_9$ | −0.121 | 25 | 85 | Good | 2.88 | 2.34 |
| 77 | Ex. | $Fe_{75.5}Cu_1Nb_1Si_{13.5}B_9$ | −0.111 | 18 | 93 | Good | 2.89 | 3.19 |
| 79 | Ex. | $Fe_{71.5}Cu_1Nb_5Si_{13.5}B_9$ | −0.103 | 2 | 99 | Excellent | 3.12 | 3.45 |
| 80 | Comp. Ex. | $Fe_{66.5}Cu_1Nb_{10}Si_{13.5}B_9$ | −0.093 | 132 | 100 | Excellent | 2.43 | 2.66 |
| 81 | Ex. | $Fe_{73.5}Cu_1Ti_3Si_{13.5}B_9$ | −0.113 | 8 | 94 | Excellent | 2.84 | 2.88 |
| 82 | Ex. | $Fe_{73.5}Cu_1Zr_3Si_{13.5}B_9$ | −0.102 | 2 | 98 | Excellent | 2.89 | 2.93 |
| 83 | Ex. | $Fe_{73.5}Cu_1Hf_3Si_{13.5}B_9$ | −0.106 | 6 | 95 | Excellent | 2.84 | 2.95 |
| 84 | Ex. | $Fe_{73.5}Cu_1V_3Si_{13.5}B_9$ | −0.103 | 7 | 93 | Excellent | 2.84 | 2.98 |
| 85 | Ex. | $Fe_{73.5}Cu_1Ta_3Si_{13.5}B_9$ | −0.102 | 5 | 92 | Excellent | 2.84 | 2.94 |
| 86 | Ex. | $Fe_{73.5}Cu_1Mo_3Si_{13.5}B_9$ | −0.106 | 4 | 97 | Excellent | 2.84 | 2.96 |
| 87 | Ex. | $Fe_{73.5}Cu_1Hf_{1.5}Nb_{1.5}Si_{13.5}B_9$ | −0.104 | 2 | 99 | Excellent | 2.86 | 2.89 |
| 88 | Ex. | $Fe_{79.5}Cu_1Nb_2Si_{9.5}B_9C_1$ | −0.107 | 4 | 99 | Excellent | 2.86 | 2.94 |
| 89 | Ex. | $Fe_{79}Cu_1Nb_2Si_9B_5C_4$ | −0.105 | 5 | 93 | Good | 2.84 | 2.81 |
| 90 | Ex. | $Fe_{73.5}Cu_1Nb_3Si_{13.5}B_8C_1$ | −0.103 | 3 | 97 | Excellent | 2.85 | 2.98 |
| 91 | Ex. | $Fe_{73.5}Cu_1Nb_3Si_{13.5}B_5C_4$ | −0.106 | 2 | 96 | Excellent | 2.81 | 2.89 |
| 94 | Ex. | $Fe_{86.9}Cu_{0.1}P_1Si_2B_9C_1$ | −0.104 | 6 | 97 | Excellent | 2.85 | 5.32 |
| 95 | Ex. | $Fe_{80.9}Cu_{0.1}P_1Si_8B_9C_1$ | −0.103 | 5 | 98 | Excellent | 2.87 | 5.3 |
| 96 | Ex. | $Fe_{82.9}Cu_{0.1}P_2Si_2B_9C_4$ | −0.104 | 5 | 96 | Excellent | 2.93 | 4.32 |
| 97 | Ex. | $Fe_{76.9}Cu_{0.1}P_2Si_8B_9C_4$ | −0.105 | 3 | 97 | Excellent | 2.95 | 4.23 |

From the results in Table 3, all the examples in which slope of approximate straight line was −0.1 to −0.4, amorphization ratio X was 85% or more, and B content variation σB was 2.8 or more showed preferable coercive force Hc. In addition, all the examples in which M content variation σM was 2.8 or more showed preferable coercive force Hc.

(Experiment 4)

Tests were conducted under the same conditions as in Experiment 3, except that a part of Fe in Sample No. 25 was replaced with other elements and the kind of M was varied. Further, with respect to sample Nos. 62 and 82 to 86, the tests were conducted under the same conditions as in Experiment 3 except that the kind of M was varied. Results are shown in Tables 4 and 5.

TABLE 4

| Sample No. | Ex. or Comp. Ex. | Composition | Slope | Coercive force Hc (A/m) | Amorphization Ratio (%) | 180 Degree Adhesion Test | B (σ) | M (σ) |
|---|---|---|---|---|---|---|---|---|
| 25 | Ex. | $Fe_{84}Nb_7B_9$ | −0.111 | 6.6 | 98 | Excellent | 2.98 | 3.10 |
| 41 | Ex. | $Fe_{90}Zr_7B_3$ | −0.115 | 4.3 | 96 | Excellent | 3.35 | 2.97 |
| 43 | Ex. | $Fe_{90}Hf_7B_3$ | −0.103 | 6.14 | 86 | Good | 3.35 | 2.95 |
| 25a | Ex. | $Fe_{83}Nb_7B_9P_1$ | −0.106 | 4.3 | 96 | Excellent | 2.91 | 2.95 |
| 25b | Ex. | $Fe_{82}Nb_7B_9P_2$ | −0.117 | 3.8 | 96 | Excellent | 2.91 | 2.95 |
| 25c | Ex. | $Fe_{81}Nb_7B_9P_3$ | −0.12 | 2.6 | 98 | Excellent | 2.93 | 2.95 |
| 25d | Ex. | $Fe_{80}Nb_7B_9P_3Si_1$ | −0.11 | 4.3 | 94 | Excellent | 2.93 | 2.95 |
| 25e | Ex. | $Fe_{78}Nb_7B_9P_3Si_3$ | −0.101 | 2.9 | 93 | Excellent | 2.94 | 3.10 |
| 25f | Ex. | $Fe_{76}Nb_7B_9P_3Si_5$ | −0.12 | 2.8 | 94 | Excellent | 2.93 | 3.12 |
| 25g | Ex. | $Fe_{71}Nb_7B_9P_3Si_{10}$ | −0.11 | 2.9 | 95 | Excellent | 2.94 | 3.15 |
| 25h | Ex. | $Fe_{80}Nb_7B_9P_3C_1$ | −0.105 | 2.8 | 94 | Excellent | 2.96 | 3.14 |

TABLE 4-continued

| Sample No. | Ex. or Comp. Ex. | Composition | Slope | Coercive force Hc (A/m) | Amorphization Ratio (%) | 180 Degree Adhesion Test | B (σ) | M (σ) |
|---|---|---|---|---|---|---|---|---|
| 25i | Ex. | $Fe_{78}Nb_7B_9P_3C_3$ | −0.111 | 2.7 | 92 | Excellent | 2.91 | 3.15 |
| 25j | Ex. | $Fe_{76}Nb_7B_9P_3C_5$ | −0.121 | 3.5 | 93 | Excellent | 2.94 | 3.21 |
| 25k | Ex. | $Fe_{79}Nb_7B_9P_3Si_1C_1$ | −0.111 | 3.5 | 94 | Excellent | 2.93 | 3.14 |
| 25l | Ex. | $Fe_{77}Nb_7B_9P_3Si_3C_1$ | −0.107 | 3.4 | 94 | Excellent | 2.94 | 3.12 |
| 25m | Ex. | $Fe_{75}Nb_7B_9P_3Si_5C_1$ | −0.106 | 3.2 | 95 | Excellent | 2.91 | 3.17 |
| 25n | Ex. | $Fe_{80}Nb_7B_9P_3Cu_1$ | −0.123 | 2.9 | 97 | Excellent | 2.94 | 3.18 |
| 25o | Ex. | $Fe_{80}Nb_7B_9P_3Si_1Cu_1$ | −0.124 | 2.7 | 95 | Excellent | 2.94 | 3.16 |
| 25p | Ex. | $Fe_{79}Nb_7B_9P_3C_1Cu_1$ | −0.125 | 2.8 | 98 | Excellent | 2.96 | 3.17 |
| 25q | Ex. | $Fe_{78}Nb_7B_9P_3Si_1C_1Cu_1$ | −0.117 | 2.7 | 96 | Excellent | 2.94 | 3.13 |
| 25r | Ex. | $Fe_{84}Ti_7B_9$ | −0.104 | 7.3 | 86 | Good | 2.99 | 2.99 |
| 25s | Ex. | $Fe_{84}V_7B_9$ | −0.107 | 7.4 | 85 | Good | 2.85 | 2.94 |
| 25t | Ex. | $Fe_{84}Ta_7B_9$ | −0.109 | 7.4 | 85 | Good | 2.87 | 2.91 |
| 25u | Ex. | $Fe_{84}Mo_7B_9$ | −0.108 | 7.5 | 86 | Good | 2.87 | 2.95 |
| 25v | Ex. | $Fe_{84}P_7B_9$ | −0.101 | 5.2 | 99 | Excellent | 2.88 | 2.94 |
| 25w | Ex. | $Fe_{84}Cr_7B_9$ | −0.105 | 6.5 | 85 | Good | 2.86 | 2.95 |

TABLE 5

| Sample No. | Ex. or Comp. Ex. | Composition | Slope | Coercive force Hc (A/m) | Amorphization Ratio (%) | 180 Degree Adhesion Test | B (σ) | M (σ) |
|---|---|---|---|---|---|---|---|---|
| 62 | Ex. | $Fe_{73.5}Cu_1Nb_3Si_{13.5}B_9$ | −0.104 | 3 | 95 | Excellent | 2.84 | 2.89 |
| 82 | Ex. | $Fe_{73.5}Cu_1Zr_3Si_{13.5}B_9$ | −0.102 | 2 | 98 | Excellent | 2.89 | 2.93 |
| 83 | Ex. | $Fe_{73.5}Cu_1Hf_3Si_{13.5}B_9$ | −0.106 | 6 | 95 | Excellent | 2.84 | 2.95 |
| 84 | Ex. | $Fe_{73.5}Cu_1V_3Si_{13.5}B_9$ | −0.103 | 7 | 93 | Excellent | 2.84 | 2.98 |
| 85 | Ex. | $Fe_{73.5}Cu_1Ta_3Si_{13.5}B_9$ | −0.102 | 5 | 92 | Excellent | 2.84 | 2.94 |
| 86 | Ex. | $Fe_{73.5}Cu_1Mo_3Si_{13.5}B_9$ | −0.106 | 4 | 97 | Excellent | 2.84 | 2.96 |
| 86a | Ex. | $Fe_{73.5}Cu_1Cr_3Si_{13.5}B_9$ | −0.106 | 4 | 94 | Excellent | 2.85 | 2.95 |

From the results in Tables 4 and 5, all the examples in which slope of approximate straight line was −0.1 to −0.4, amorphization ratio X was 85% or more, and B content variation σB was 2.8 or more showed preferable coercive force Hc. In addition, all the examples in which M content variation σM was 2.8 or more showed preferable coercive force Hc.

(Experiment 5)

Each pure metal material was weighed and obtained a mother alloy having the following composition: Fe:84 atom %, B:9.0 atom % and Nb:7.0 atom %. After vacuum evacuation in the chamber, the pure metal materials were melted by high frequency heating and prepared the mother alloy.

Thereafter, the prepared mother alloy was heated and melted to obtain a metal in a molten state of 1300° C. Then the metal was injected by a composition condition shown in the following Table 6 by a gas atomization method and prepared a powder. In Experiment 5, the gas injection temperature was set to 100° C. and the vapor pressure in the chamber was set to four hPa to prepare a sample. The steam pressure adjustment was carried out by using Ar gas, which was subjected to dew point adjustment.

The evaluations carried out in Experiments. 1 to 4 were carried out in Experiment 5, except for the 180-degree adhesion test.

TABLE 6

| Sample No. | Ex. or Comp. Ex. | Composition | Slope | Coercive force Hc (A/m) | Amorphization Ratio (%) | B (σ) | M (σ) |
|---|---|---|---|---|---|---|---|
| 98 | Ex. | $Fe_{84}Nb_7B_9$ | −0.123 | 93 | 94 | 2.98 | 3.1 |
| 99 | Ex. | $Fe_{73.5}Cu_1Nb_3Si_{13.5}B_9$ | −0.112 | 65 | 98 | 2.84 | 2.97 |

From the examples of the soft magnetic alloy powder shown in Table 6, similar to the ribbon, all the examples in which slope of approximate straight line was −0.1 to −0.4, amorphization ratio X was 85% or more, and B content variation σB was 2.8 or more showed preferable coercive force Hc.

NUMERICAL REFERENCES

11 . . . Soft magnetic alloy
12 . . . Measurement Range
13 . . . Grid
21 . . . Nozzle
22 . . . Molten metal
23 . . . Roll
24 . . . Ribbon
25 . . . Chamber
26 . . . Peel gas injector

The invention claimed is:

1. A soft magnetic alloy comprising Fe as a main component, wherein the soft magnetic alloy comprises $Fe_aCu_bM1_cSi_dB_eC_f$, wherein a+b+c+d+e+f=100, 0.0≤b≤3.0, 0.0≤c≤10.0, 0.0≤d≤17.5, 5.0≤e≤13.0, and 1.0≤f≤3.0, and M1 is one or more selected from a group consisting of Nb, Ti, Zr, Hf, V, Ta, Mo, P and Cr, a slope of an approximate straight line, plotted between cumulative frequencies of 20 to 80% on Fe content (atom %) in each grid of 80000 grids or more, each of which has 1 nm×1 nm×1 nm, is −0.101 to −0.38, provided that Fe content (atom %) of each grid is Y axis, and the cumulative frequencies (%) obtained in descending order of Fe content in each grid is X axis, and an amorphization ratio X of the soft magnetic alloy represented by the following formula (1) is 85% or more.

$$X=100-(Ic/(Ic+Ia)\times 100) \quad (1)$$

Ic: crystalline scattering integrated intensity

Ia: amorphous scattering integrated intensity.

2. The soft magnetic alloy according to claim 1, wherein M1 content variation (σM1) is 2.8 or more in grid of 95% or more cumulative frequency (%) on Fe content.

3. The soft magnetic alloy according to claim 1, wherein the slope of the approximate straight line is −0.101 to −0.2, and the amorphization ratio X of formula (1) is 95% or more.

4. The soft magnetic alloy according to claim 1, wherein

B content standard deviation (σB) is 2.8 or more in the grids having 95% or more cumulative frequency (%) on Fe content.

5. The soft magnetic alloy according to claim 1, wherein the soft magnetic alloy has a coercive force Hc that is 45 A/m or less.

6. The soft magnetic alloy according to claim 1, wherein the soft magnetic alloy has a coercive force Hc that is 28 A/m or less.

7. A soft magnetic alloy comprising Fe as a main component, wherein the soft magnetic alloy comprises $Fe_\alpha M2_\beta B_{65} C_\Omega$, wherein α+β+γ+Ω=100, 1.0 ≤β≤20.0, 2.0≤γ≤20.0 and 1.0≤Ω≤3.0 and M2 is one or more selected from a group consisting of Nb, Cu, Zr, Hf, Ti, V, Ta, Mo, P, Si and Cr, a slope of an approximate straight line, plotted between cumulative frequencies of 20 to 80% on Fe content (atom %) in each grid of 80000 grids or more, each of which has 1 nm×1 nm×1 nm, in a continuous measurement range of the soft magnetic alloy, is −0.101 to −0.38, provided that Fe content (atom%) of each grid is Y axis, and the cumulative frequencies (%) obtained in descending order of Fe content in each grid is X axis, and an amorphization ratio X of the soft magnetic alloy represented by the following formula (1) is 85% or more:

$$X=100-(Ic/(Ic+Ia)\times 100) \quad (1)$$

Ic: crystalline scattering integrated intensity

Ia: amorphous scattering integrated intensity.

8. The soft magnetic alloy according to claim 7, wherein

M2 content standard deviation (σM2) is 2.8 or more in the grids of 95% or more cumulative frequency (%) on Fe content.

9. The soft magnetic alloy according to claim 7, wherein the slope of the approximate straight line is −0.101 to −0.2, and the amorphization ratio X of formula (1) is 95% or more.

10. The soft magnetic alloy according to claim 7, wherein

B content standard deviation (σB) is 2.8 or more in the grids having 95% or more cumulative frequency (%) on Fe content.

11. The soft magnetic alloy according to claim 7, wherein the soft magentic alloy has a coercive force Hc that is 45 A/m or less.

12. The soft magnetic alloy according to claim 7, wherein the soft magnetic alloy has a coercive force Hc that is 28 A/m or less.

13. A magnetic device comprising the soft magnetic alloy according to claim 1.

14. A magnetic device comprising the soft magnetic alloy according to claim 7.

* * * * *